United States Patent [19]

Arikawa et al.

[11] 4,100,523

[45] Jul. 11, 1978

[54] TIME-LAG FUSE

[75] Inventors: Hiroo Arikawa, Tokyo; Masaya Maruo, Yokohama, both of Japan

[73] Assignee: San-O Industrial Co., Ltd., Tokyo, Japan

[21] Appl. No.: 743,314

[22] Filed: Nov. 19, 1976

[30] Foreign Application Priority Data

Nov. 26, 1975 [JP] Japan ..... 50-159303

[51] Int. Cl.[2] ..... H01H 85/04; H01H 85/18

[52] U.S. Cl. ..... 337/163; 337/276

[58] Field of Search ..... 337/276, 278, 163, 166, 337/158, 159

[56] References Cited

U.S. PATENT DOCUMENTS

| | | | |
|---|---|---|---|
| 3,069,520 | 12/1962 | Cameron | 337/158 |
| 3,876,966 | 4/1975 | Fister | 337/159 |

FOREIGN PATENT DOCUMENTS

| | | | |
|---|---|---|---|
| 611,680 | 4/1935 | Fed. Rep. of Germany | 337/276 |

*Primary Examiner*—Harold Broome

[57] ABSTRACT

A time-lag fuse is provided which exhibits improved breaking capacity due to its novel construction. It comprises a fuse element which is securely positioned within an insulating cylindrical tube such as a glass cartridge, and a plurality of sintered ceramic bodies (e.g., cylindrical or polygonal) are circumferentially disposed within said tube so as to define a space therewith to achieve the required fusing and time-lag characteristics. The sintered ceramic bodies are arranged so as to define plurality of spaces between adjacent pairs of the ceramic bodies and the insulating tube in order to buffer the pressure created by arcing between the ceramic bodies and the insulating tube during a current overload.

1 Claim, 3 Drawing Figures

TIME-LAG FUSE

BACKGROUND OF THE INVENTION

This invention relates to a time-lag fuse using several fine ceramic sintered bodies which are porous or superior in heat conduction as arc extinction material.

A fuse filled with arc extinction material to elevate the breaking capacity is defective in that, due to irregularities in grain distribution of the arc extinction material, the filling rate varies so that the fuse characteristics are hard to stabilize. And a current-limiting fuse using a porous ceramic sintered body as arc extinction material to eleminate such irregularities in grain distribution is publicly known, but this type of fuse poses problems such that, because of its construction in which the fuse element and the ceramic sintered body are contacted with each other directly, the heat transfer from the fuse element to the ceramic sintered body is great, that, due to such heat transfer, the thermal balance of the fuse element varies so that the time-lag characteristic of the fuse element lowers and, at the same time, the ceramic sintered body and the insulating cylinder strikingly rise in temperature, that, in the case where a spirally wound fuse element is placed inside the ceramic sintered body, it is difficult to contact the fuse element and the ceramic sintered body with each other uniformly over the lengths thereof, so that the fusing characteristic of the fuse is hard to stabilize, and so forth.

SUMMARY OF THE INVENTION

This invention relates to a time-lag fuse wherein, in order to eliminate such drawbacks, several fine ceramic sintered bodies which are porous or superior in heat conduction, as arc extinction material, are positioned around but spaced from the fuse element so as to provide a space required for the fusing characteristic of the fuse, whereby the breaking capacity has been elevated without lowering the fusing characteristic of the fuse element and without making the same unstable, in whatsoever shape the fuse element may be, such as in the case where it is single or several in number, where it is a spirally wound fuse element, where it is composed of several metal wires of the same kind or different kinds put together, where it is a fuse element comprising a metal wire spirally wound round a support, where it is shaped like a ribbon, or the like.

DESCRIPTION OF THE PREFERRED EMBODIMENT

Figure 1:
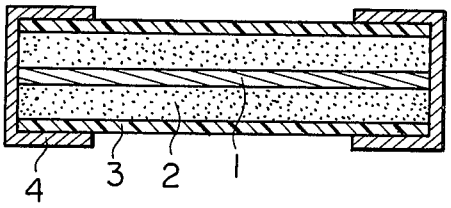
Fig. 1 PRIOR ART
FIG. 1 is a longitudinal sectional view showing a conventional current-limiting fuse.

A conventional prior art fuse filled with arc extinction material to elevate the breaking capacity is generally constructed so that, as shown in FIG. 1, a fuse element 1 and arc extinction material 2 are received in an insulating cylinder 3, both ends of said fuse element 1 being connected to cap terminals 4 which cover both ends of said insulative cylinder 3 both ends of said fuse element 1 being connected to cap terminals 4 which cover both ends of said insulating cylinder 3 respectively.

Figure 2:
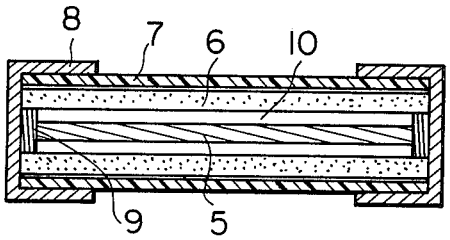
FIG. 2 and FIG. 3 are longitudinal and cross sectional views respectively showing an embodiment of this invention.
Figure 3:
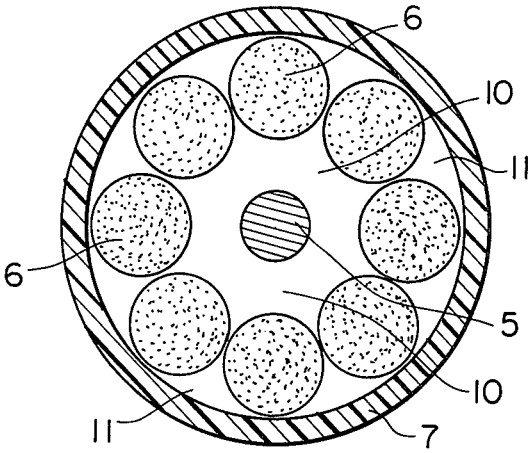

FIG. 2 and FIG. 3 illustrate one embodiment of this invention, FIG. 3 being a cross-sectional view of FIG. 2.

In this embodiment, the fuse is constructed of a fuse element 5 placed at the center inside an insulating cylinder 7, and several cylindrical ceramic sintered bodies 6 arranged within said insulating cylinder 7 but spaced from said fuse element 5 as in FIG. 3 to form a space around said fuse element 5 that is required for exhibiting the time-lag characteristic stability, with an electrically conductive projection 9 being provided at both ends of said fuse element 5 to separate it from said ceramic sintered bodies 6 and a cap terminal 8 being put on both ends of said insulating cylinder 7 to close it, said cap terminals 8 and said projections 9 of said fuse element 5 being connected together.

In this construction, as shown in FIG. 3, with respect to the fuse element 5, several cylindrical ceramic sintered bodies 6 are positioned along the entire circumference of a concentric circle, so that, when a large current flows, as the surface areas of the ceramic sintered bodies 6 facing the fuse element 5 that effect the arc extinction action are large, the metal vapor of the fuse element 5 can be cooled quickly. Also, the spaces 11 between the insulating cylinder 7 and the ceramic sintered bodies 6 are spaces such that, when the pressure of the space 10 is suddenly raised by an arc, the metal vapor is passed while being cooled and decelerated through small gaps between the respective adjacent ceramic sintered bodies 6 into said spaces 11, whereby to buffer the pressure of the space 10 and simultaneously therewith to space 10 to quicken arc extinction.

With the above-mentioned construction, it is possible to economically mass-produce a time-lag fuse which is superior in breaking capacity and which is free from irregularities in fusing characteristic due to the contact of a fuse element with a granular or sintered-body arc as well as from lowering in time-lag characteristic.

In FIG. 3, the case where the ceramic sintered bodies 6 are cylindrical is shown, but, needless to say, in the case where they are oval or polygonal pillar-shaped, the same action and effect as those mentioned above can also be produced.

What is claimed is:

1. A time-lag fuse having improved breaking capacity comprising a fuse element securely disposed within an insulating cylindrical tube, a plurality of sintered ceramic bodies circumferentially disposed within said insulating cylindrical tube in spaced relation to said fuse element, each adjacent pair of said ceramic bodies defining a space between them and said insulating cylindrical tube for buffering the pressure produced by the arc between said ceramic bodies and said insulating cylindrical tube.

* * * * *